United States Patent [19]

Dahlquist

[11] 4,020,296

[45] Apr. 26, 1977

[54] ELECTROACOUSTIC TRANSDUCER

[76] Inventor: Jon G. Dahlquist, 500 E. 85th St., New York, N.Y. 10028

[22] Filed: Jan. 19, 1976

[21] Appl. No.: 650,146

[52] U.S. Cl. ..... 179/115.5 PV; 179/115 V

[51] Int. Cl.[2] ..... H04R 9/00

[58] Field of Search .... 179/115 R, 115 V, 115.5 R, 179/115.5 PV, 115.5 SF, 114 R

[56] References Cited

UNITED STATES PATENTS

| | | | |
|---|---|---|---|
| 1,955,390 | 4/1934 | Schiffl | 179/112 |

FOREIGN PATENTS OR APPLICATIONS

| | | | |
|---|---|---|---|
| 504,832 | 2/1929 | Germany | 179/115.5 PV |
| 500,723 | 11/1928 | Germany | 179/115.5 PV |
| 379,167 | 8/1932 | United Kingdom | 179/115.5 R |

OTHER PUBLICATIONS

IBM Technical Disclosure Bulletin vol. 6 No. 7 Dec. 1963, pp. 87–88 "Electromagnetic Transducer" J.J. Colligan et al.

*Primary Examiner*—George G. Stellar

*Attorney, Agent, or Firm*—Mark T. Basseches; Paula T. Basseches

[57] ABSTRACT

The present invention is directed to an improved electroacoustic transducer of the type in which electrical conductors are mounted over a substantial portion of the radiating area of a movable diaphragm, characterized in that the electromagnetic forces exerted on the diaphragm are linear throughout the entire excursion of the diaphragm. The apparatus includes an acoustically transparent solenoid member having spaced-apart turns, the diaphragm being disposed within the area bounded by the solenoid turns, and having a conductor mounted on or comprising the diaphragm. A D.C. current is passed through the coil while the output of an audio amplifier is impressed on the conductor. The above arrangement is unique in that the flux density within the area bounded by the solenoid being essentially equal at all points, the conductor is subjected to essentially constant magnetic forces, notwithstanding its position within the solenoid.

6 Claims, 3 Drawing Figures

ELECTROACOUSTIC TRANSDUCER

BACKGROUND OF THE INVENTION

Field of the Invention

The present invention is in the field of electroacoustic transducers.

The Prior Art

Electroacoustic transducers presently in use, such as loudspeakers, earphones and the like, may be generally divided into two types, notably electromagnetic and electrostatic.

In the electrostatic transducer, a membrane or diaphragm carrying a conductor is disposed between oppositely charged plates. When an audio signal is impressed on the conductor, the conductor and, hence, the diaphragm, are attracted and repelled between the plates in accordance with the impressed signal, thereby transforming the electrical energy to acoustical energy.

In the electromagnetic type of transducer, a diaphragm having a conductor is disposed within a magnetic field, typically within an annular gap in a permanent magnet element. In the most conventional type of electromagnetic transducer, the conductor is wound in the form of a coil, known as a voice coil, and shifts within the gap in accordance with the electrical signal passed through the coil, the coil being attached to a radiating diaphragm of conical or other form, resulting in the production of sound. In such reproducers, the diaphragm is not driven with forces applied over the entirety of the surface thereof, with the result that a variety of forms of distortion are introduced into the sound generated, resulting in large measure from so-called "cone break up."

In later forms of electromagnetic transducers, as exemplified by U.S. Pat. No. 3,674,946, attempts have been made to eliminate break up distortion by driving the entire surface of a large radiating diaphragm, the diaphragm being provided with a sinuous conductor path, adjacent which large fixed magnetic members are disposed.

In electrostatic transducers, there is typically provided a relatively large radiating diaphragm, which diaphragm is driven over the entirety of its surface, such that the diaphragm moves essentially as a unit, minimizing harmonic and intermodulation distortions which result from different parts of the diaphragm moving independently.

Electrostatic reproducers, while providing an extremely high quality of reproduction, have certain inherent disadvantages, including the requirement for providing well filtered high polarizing voltages, operation at or near ionizing potentials, and non-linear displacement during large excursions.

In both forms of transducers (electromagnetic and electrostatic) of the type employing radiating diaphragms driven over substantially their entire surface, distortion products are introduced as a result of non-linearity of movement of the diaphragm. More particularly, as the conductor within the force field is moved progressively closer to the source of magnetic forces in an electromagnetic transducer, or the polarized plate in the case of an electrostatic reproducer, the forces exerted on the conductor increase in inverse ratio to the square of the distance. Thus, doubling of the current flow in the conductors (assuming free suspension) will result in a greater than doubling of the deflection of the diaphragm. The forces may thus be said to be non-linear, and introduce into the sound elements of harmonic and intermodulation distortions.

SUMMARY OF THE INVENTION

The present invention is predicated upon the provision of an acoustically transparent solenoid having mounted within the area bounded by the solenoid turns, a movable diaphragm carrying a conductor. When a direct current voltage is connected across the solenoid, there is formed within the solenoid a magnetic force which is equal or substantially equal throughout the entirety of the area bounded by the solenoid. As a result, when an alternating current output of an amplifier is connected to the conductor carried on the diaphragm, the forces exerted on the conductor are independent of the spacing between the conductor and the solenoid turns. Hence, the forces urging the diaphragm one way or the other will be independent of any excursion of the diaphragm, i.e. will be linear throughout the range of travel of the diaphragm.

While preferably D.C. current is passed through the solenoid turns, and the electrical signal from the amplifier is fed to the conductor on the diaphragm, it is feasible to feed the D.C. to the diaphragm conductor and impress the audio signal on the solenoid.

It is accordingly an object of the invention to provide an improved electromagnetic transducer, such as a loudspeaker, headphone or the like.

It is a further object of the invention to provide an improved transducer of the type described wherein the forces exerted on the radiating diaphragm are unaffected by excursions of the diaphragm.

Still a further object of the invention is the provision of a transducer of the type described, including an acoustically transparent solenoid having opposed parallel faces and a planar radiating diaphragm mounted within the solenoid, the magnetic flux within the solenoid being essentially a constant at all points within the solenoid.

To attain these objects and such further objects as may appear herein or be hereinafter pointed out, reference is made to the accompanying drawings, forming a part hereof, in which.

Figure 1:
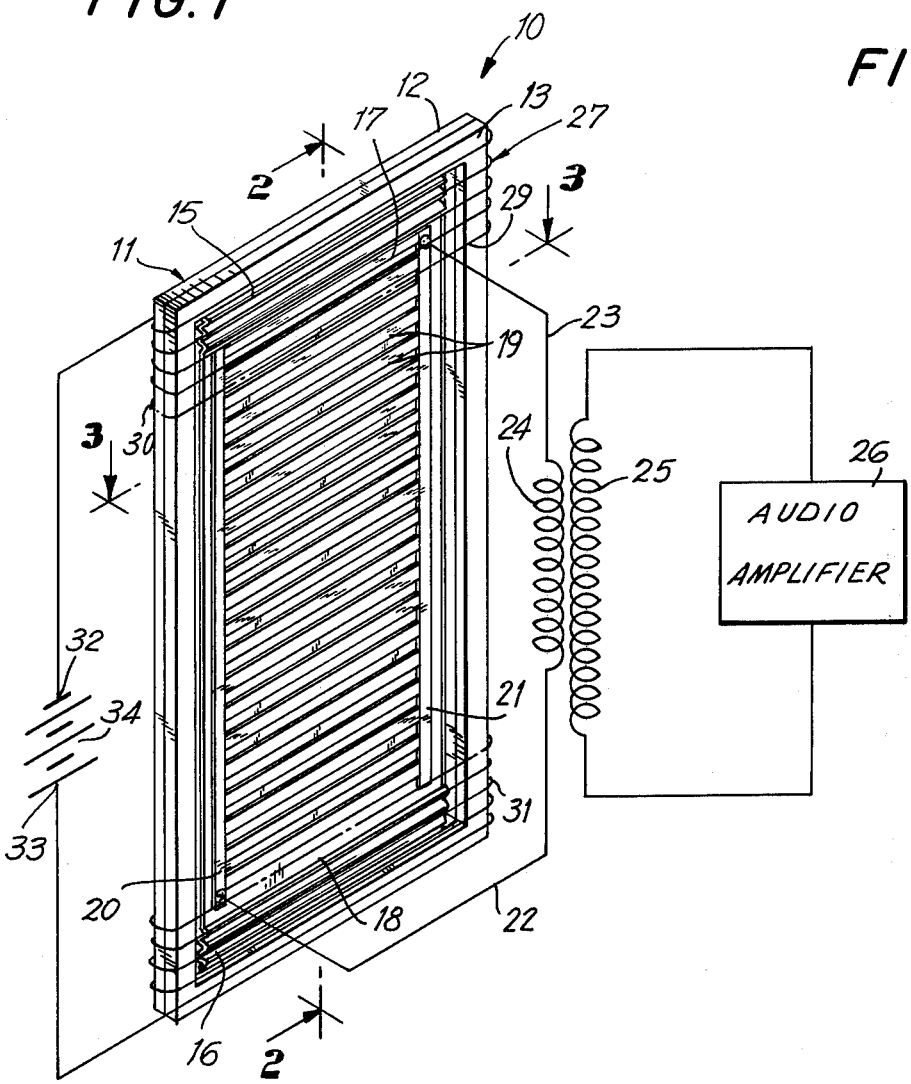
FIG. 1 is a perspective schematic view of a loudspeaker apparatus in accordance with the invention.
Figure 2:
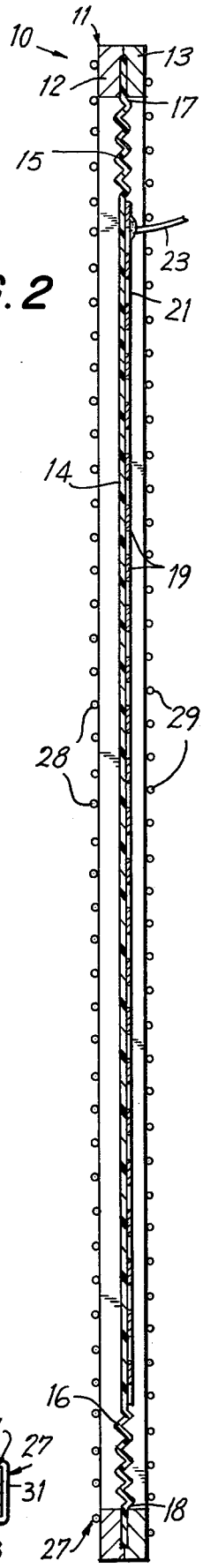
FIG. 2 is a magnified vertical section taken on the line 2—2 of FIG. 1.
Figure 3:
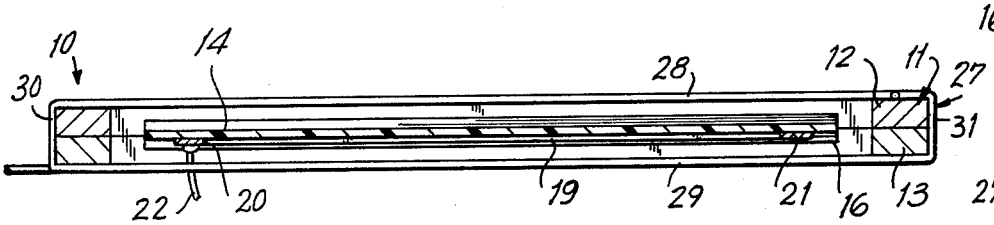
FIG. 3 is a magnified horizontal section taken on the line 3—3 of FIG. 1.

Referring now to the drawings, there is disclosed an electromagnetic transducer 10 comprising an open rectangular frame member 11, the frame member 11 being formed of two congruent frame halves 12, 13.

A radiating diaphragm 14 is mounted within the frame 11. Preferably the diaphragm 14 may be comprised of extremely thin gauge Mylar or like light weight plastic material. Optionally, a flexible suspension is provided by the accordion-like suspension portions 15, 16 fixed to the upper and lower ends 17 and 18, whereby the diaphragm 14 may move as a unit. It will be appreciated that the accordion components 15, 16 may be formed integrally with the diaphragm 14 or may be secured thereto.

In practice, the end portions of the accordion suspension 15, 16 may be sandwiched between the upper and lower ends of the frame halves 13, 12 before the frames are united, in the manner shown.

The diaphragm 14 is provided with a conductor member, the conductor being preferably comprised of a multiplicity of horizontally disposed parallel conductor strips 19 running between a spaced pair of feeder strips 20, 21. A first connection 22 to feeder strip 20 and a second connection 23 to feeder strip 21, provide the output terminals of the diaphragm, it being appreciated that the conductor strips 19 define electrically parallel connection circuits rather than a series circuit between the feeder strips 20, 21.

The connections 22, 23 are connected to the secondary winding 24 of a step down transformer, the primary winding 25 of the transformer being connected to the output of an audio amplifier 26. A step down transformer is normally required to match the impedance characteristics of the amplifier to that of the diaphragm conductors, the latter providing, in the embodiment more particularly described hereinafter, an essentially resistive load of less than one ohm.

The frame 11 forms a core, about which is wound a flat, acoustically transparent solenoid member 27. The solenoid 27 is formed of a multiplicity of spaced turns of wire, each turn including a pair of front and rear, longitudinally extending portions 28, 29 which run parallel with the opposed faces of the diaphragm, and side or depthwisely extending portions 30, 31 connecting adjacent longitudinal elements of the turns. As will be apparent from FIG. 1, the longitudinal components of each turn are substantially longer than the depthwisely extending components.

The terminal ends 32, 33 of the solenoid are connected to a source of direct current, such as, by way of illustration, a battery 34, altho in commercial practice a well filtered D.C. power supply would be employed.

It will be readily recognized that specific values and dimensions for the various elements of the transducer may vary within a wide range in accordance with the desired end result. By way of example, and without limitation, a loudspeaker element with the following parameters has been fabricated, tested and found to operate in a satisfactory manner.

In the test embodiment, the Mylar diaphragm comprised essentially a one foot by two foot rectangle, the short ends of the rectangle being fixed to the short ends of the open frame assembly. Parallel aluminum foil conductors were glued to one face of the diaphragm, the conductors being approximately one half inch in width, and separated by approximately one sixteenth inch. The opposite ends of the conductors 19 were connected respectively to aluminum foil strips positioned along the lengthwise margins of the diaphragm at positions corresponding to connector strips 20 and 21, said connector strips being wired to the secondary terminals of a step down transformer having a 20 to 1 ratio.

The primary of the step down transformer was connected to the output of a conventional audio amplifier.

The solenoid coil was wound about the frame, the coil consisting of No. 14 monofilamentary enamelled copper wire wound about the frame with approximately 0.1 inch spacing between adjacent turns. The thickness of the frame was such as to space the longitudinally extending lengths of wire defining the solenoid by approximately one half inch. The leads to the solenoid were connected to the terminals of a conventional 12 volt automobile battery.

The flux density within the solenoid measured approximately 175 to 200 Gauss and was essentially independent of the measuring position within the solenoid.

The noted prototype produced diaphragm displacement forces of approximately 150 dynes/cm$^2$ when connected to a 100 watt (RMS) audio amplifier operating just below clipping.

The prototype was observed to produce sound of excellent tonal qualities and to have a wide useful reproduction range. The sound was subjectively determined to be free or substantially free of harmonic, intermodulation and other distortion products.

Through the use of D.C. voltages inpressed on the conductive diaphragm path, deflection of the diaphragm was observed to be almost precisely current dependent, e.g. was linear.

The useful sound output from the unit approximated in volume that obtained from a comparably sized electrostatic reproducing unit.

Although the solenoid did evidence certain heating effects, modification of operating parameters would unquestionably permit such effects to be maintained within satisfactory limits.

Similarly, variations in such parameters as spacing of the turns of the solenoid, separation of the parallel conductors comprising the solenoid, over-all size of the solenoid and diaphragm, resistance of the conductive components of the diaphragm, modifications of the transformer required to match the impedance of the audio amplifier to the conductive path of the diaphragm, etc., will permit tailoring of the characteristics of the transducer to the intended function of the transducer.

By way of example, the size of a diaphragm intended for bass or full range reproduction will unquestionably be larger than one calculated to reproduce merely the upper elements of the audio spectrum.

In accordance with a further modification, it is practicable to connect the solenoid terminals to the output of the audio amplifier and the conductive components of the diaphragm to a D.C. voltage, the linear attraction effects hereinabove discussed being retained under such circumstances.

While there is illustrated in the accompanying drawings a transducer employing a planar diaphragm 14 and solenoid turns whose opposed longitudinal elements 28 and 29 respectively are aligned in first and second planes parallel to and at opposite sides of the diaphragm, it will be readily apparent that other configurations of diaphragm and solenoid may be employed without departing from the spirit of the invention.

In applications where high frequencies only are to be reproduced, a separate diaphragm may be dispensed with, the conductor, preferably in the form of one or more ribbons, functioning also as the diaphragm.

The invention, in its broadest aspects, is considered to reside in the concept of providing an acoustically transparent solenoid for driving a diaphragm having or comprised of a conductive element movably mounted in the space bounded by the solenoid, taking advantage of the essentially constant value magnetic field generated within the solenoid to assure a linear deflection of the diaphragm.

The transducer is, thus, a radical departure from transducers heretofore known, whether of the electrostatic or electromagnetic type, wherein diaphragm deflecting forces vary in a non-linear manner in accordance with the spacing between the diaphragm and the force inducing component. Accordingly, the invention is to be broadly construed within the scope of the appended claims.

Having thus described the invention and illustrated its use, what is claimed as new and is desired to be secured by Letters Patent is:

1. An electroacoustical transducer comprising a substantially planar acoustically transparent solenoid coil member including a plurality of substantially equally spaced-apart individual turns bounding an area in space, a radiating diaphragm movably mounted within said area, a plural path conductor member on said diaphragm in proximate spaced relation to the turns of said solenoid, and means for impressing a D.C. voltage on one said member, and an alternating current signal from an audio amplifier on the other said member.

2. Apparatus in accordance with claim 1 wherein said conductor means include a multiplicity of conductor paths disposed substantially parallel to said turns of said solenoid coil.

3. An electroacoustic transducer, such as a loudspeaker or earphone, comprising a substantially planar, acoustically transparent, solenoidal coil member defined by a series of spaced-apart turns of conductive material, the spacing between adjacent turns of said material being at least equal to the thickness of said material, said turns being generally rectangular in section and including first and second, substantially parallel, lengthwisely extending portions and first and second, substantially parallel, depthwisely extending portions, the depthwisely extending portions being smaller in dimension than the lengthwisely extending portions, said first lengthwisely extending portions and said second lengthwisely extending portions being aligned, respectively, in first and second parallel planes, a substantially planar, yieldable diaphragm portion movably mounted in the space between said first and second planes, said diaphragm portion being disposed parallel with and halfway between the said planes, a conductor member formed on said diaphragm, said conductor member including a multiplicity of conductor paths extending substantially parallel to said lengthwise portions of said turns; and terminal means for applying a D.C. voltage to one said member, and an alternating signal current from the output of an audio amplifier to the other said member.

4. The acoustical apparatus in accordance with claim 3 wherein said conductor member includes a pair of parallel terminal strips disposed adjacent the extremities of said diaphragm nearest the widthwisely extending portions of said turns, said paths running between said strips.

5. An electroacoustic transducer device comprising an acoustically transparent helical solenoid coil member having a multiplicity of regularly spaced, substantially rectangular parallel turns, said turns including a pair of spaced lengthwisely extending portions and a pair of spaced depthwisely extending portions, said depthwisely extending portions being shorter than said lengthwisely extending portions, said lengthwisely extending portions being disposed in spaced parallel planes, a generally planar diaphragm disposed between and equidistant from said planes, means supporting said diaphragm for movement toward and away from said planes, a conductor member comprising a multiplicity of conductor paths formed on said diaphragm in parallel relation to said spaced parallel planes, means for applying a D.C. voltage to one said member and an alternating current signal from an audio amplifier to the other said members.

6. Apparatus in accordance with claim 5 wherein said conductive member includes terminal strip portions extending substantially the entire length of said diaphragm, each said terminal strip portion being disposed in parallel spaced relation to a widthwisely extending portion of said coil, said conductive paths extending directly between and perpenduclar to said terminal strip portions.

* * * * *